US005440205A

United States Patent [19]

Tahara et al.

[11] Patent Number: 5,440,205

[45] Date of Patent: Aug. 8, 1995

[54] FLUORESCENT LAMP STARTER HAVING A TRANSISTOR BASE CONTROL MEANS

[75] Inventors: Tetsuya Tahara, Ibaragi; Kazushige Sugita, Suita; Kazuhiko Ito, Hirakata; Nobuhisa Yoshikawa, Sakai, all of Japan

[73] Assignee: Matsushita Electric Industrial Co., Ltd., Kadoma, Japan

[21] Appl. No.: 128,851

[22] Filed: Sep. 28, 1993

[30] Foreign Application Priority Data

Sep. 29, 1992 [JP] Japan ..... 4-259373
Oct. 26, 1992 [JP] Japan ..... 4-287345

[51] Int. Cl.[6] ..... H05B 39/00

[52] U.S. Cl. ..... 315/94; 315/105; 315/106; 315/127; 315/DIG. 2; 315/DIG. 5

[58] Field of Search ..... 315/94, 105, 106, 127, 315/DIG. 2, DIG. 5

[56] References Cited

U.S. PATENT DOCUMENTS 3,875,459 4/1975 Remery et al. ..... 315/105
4,023,066 5/1977 Smulders ..... 315/105
5,138,236 8/1992 Bobel et al. ..... 315/209 R

FOREIGN PATENT DOCUMENTS 57-118397 7/1982 Japan .
63-38836 8/1988 Japan .
3252096 11/1991 Japan .

*Primary Examiner*—Robert J. Pascal
*Assistant Examiner*—Reginald A. Ratliff
*Attorney, Agent, or Firm*—Renner, Otto, Boisselle & Sklar

[57] ABSTRACT

A fluorescent lamp starter which includes: a series circuit to be connected to a power source for supplying an AC voltage, including a ballast and a fluorescent lamp equipped with electrodes; a transistor having a collector and an emitter connected through a diode between the electrodes on an opposite side of the fluorescent lamp in which the power source is not connected; a control voltage supply means having a resistance means and a capacitor, which are operated by a voltage between the collector and the emitter of the transistor; and a transistor base control means for switching the transistor by a total voltage of a part of a voltage generated in the resistance means of the control voltage supply means and a voltage generated in the capacitor thereof.

8 Claims, 3 Drawing Sheets

FLUORESCENT LAMP STARTER HAVING A TRANSISTOR BASE CONTROL MEANS

BACKGROUND OF THE INVENTION

1. Field of the Invention

The present invention relates to a fluorescent lamp starter, especially to a starter for starting a fluorescent lamp provided with electrodes using a semiconductor switching element.

2. Description of the Related Art

Conventionally, a glow-starter has mainly been used as a fluorescent lamp starter. However, the glow-starter has problems in that a long time is required to start the fluorescent lamp and the life of the glow-starter itself is short, and the like.

Recently, a starter using a semiconductor switching element has been developed in order to overcome the above problems. However, such a starter requires a high production cost, which hinders the expansion of the practical use thereof. Therefore, there has been an increased demand for an economical starter using a switching element.

Japanese Laid-Open Patent Publication No. 3-252096 discloses a fluorescent lamp starter using a semiconductor switching element as shown in FIG. 5. This conventional fluorescent lamp starter includes an AC power source 101, a ballast 102, a fluorescent lamp 103 having a pair of electrodes 104 and 105, a thyristor 112, a Zener diode 113, four resistances 108, 109, 114, and 115, and two capacitors 110 and 119.

An end of the electrode 104 is connected to the AC power source 101 via the ballast 102. An end of the electrode 105 is also connected to the AC power source 101. The fluorescent lamp 103 is connected to a series circuit which has the diode 106, the resistance 109, and the collector and emitter of the transistor 107, on the opposite side of the AC power source 101. The base of the transistor 107 is connected to the diode 106 via the resistance 114. A control voltage supply means for controlling the thyristor 112, which has the resistance 108 and the capacitor 110 is connected between the diode 106 and the emitter of the transistor 107. The thyristor 112 is connected between the base and the emitter of the transistor 107. The resistance 115 and the Zener diode 113 are connected between the gate of the thyristor 112 and an end of the capacitor 110 on the side of the resistance 108.

Next, the operation of the above conventional starter will be described.

If the AC power source 101 is turned ON, a current is applied between the base and the emitter of the transistor 107 via the resistance 114 when the cycle of the power source voltage is positive, thereby allowing electrical conduction between the collector and the emitter of the transistor 107. As a result, a preheat current is applied from the AC power source 101 to the ballast 102, the electrode 104, the diode 106, the resistance 109, the transistor 107, and the electrode 105. Every time the preheat current is applied so as to correspond to a half wave of the positive cycle of the power source voltage, the electrodes 104 and 105 of the fluorescent lamp 103 are preheated, and the capacitor 110 of the control voltage supply means is charged via the resistance 108. When a voltage across either end of the capacitor 110 exceeds a Zener voltage of the Zener diode 113, the current is applied to the gate of the thyristor 112 via the resistance 115, so that the thyristor 112 enters a conductive state, and the transistor 107 is turned to an OFF-state. At this time, the current is prevented from being applied to the ballast 102, so that a pulse voltage is generated at the ballast 102 having inductance, thereby starting the fluorescent lamp 103.

However, such a conventional starter has disadvantages as described below. For turning ON the thyristor 112, the voltage across the capacitor 110 should exceed the total voltage of the Zener voltage of the Zener diode 113 and the voltage between the gate and the cathode of the thyristor 112. It is difficult to maintain a fixed time period from the time at which the power source is turned ON to the time at which the thyristor 112 is turned ON according to the conventional starter. The reason is that the Zener voltage of the Zener diode 113 and the capacitance of the capacitor 110 are likely to deviate from the design value, and fluctuate depending on the environment. Therefore, it is very difficult to generate the pulse voltage from the ballast 102 with a constant timing. In addition, when the voltage across either side of the fluorescent lamp 103 is not sufficiently large, the transistor 107 is turned to an OFF-state. As a result, the pulse voltage is not sufficiently generated at the ballast 102, so that the fluorescent lamp 103 remains not to burn.

SUMMARY OF THE INVENTION

The fluorescent lamp starter of this invention includes:

a series circuit to be connected to a power source for supplying an AC voltage, including a ballast and a fluorescent lamp equipped with electrodes;

a transistor having a collector and an emitter connected through a diode between the electrodes on an opposite side of the fluorescent lamp in which the power source is not connected;

a control voltage supply means having a resistance means and a capacitor, which are operated by a voltage between the collector and the emitter of the transistor; and a transistor base control means for switching the transistor by a total voltage of a part of a voltage generated in the resistance means of the control voltage supply means and a voltage generated in the capacitor thereof.

According to another aspect of a fluorescent lamp starter includes:

a series circuit to be connected to a power source for supplying an AC voltage, including a ballast and a fluorescent lamp equipped with electrodes;

a transistor having a collector and an emitter connected through a diode between the electrodes on an opposite side of the fluorescent lamp in which the power source is not connected;

a control voltage supply means having a series circuit including a first resistance means, a second resistance means, and a capacitor connected between the collector and the emitter of the transistor; and a transistor base control means for switching the transistor by a total voltage of a voltage generated in the second resistance means of the control voltage supply means and a voltage generated in the capacitor thereof, wherein the transistor base control means comprises: a series circuit including a resistance means and a thyristor, connected between the collector and the emitter of the transistor; and a Zener diode connected between a junction, which is between the first resistance means and a series circuit including the second resistance means and the capacitor, and a gate of the thyristor, and an anode and a cathode of the thyristor are connected to a base and an emitter of the transistor, respectively.

According to another aspect of a fluorescent lamp starter includes:

a series circuit to be connected to a power source for supplying an AC voltage, including a ballast and a fluorescent lamp equipped with electrodes;

a transistor having a collector and an emitter connected through a diode and an electric current detecting element between the electrodes on an opposite side of the fluorescent lamp in which the power source is not connected;

a control voltage supply means having a resistance means and a capacitor, which are operated by a voltage between the collector and the emitter of the transistor; and a transistor base control means for switching the transistor by a total voltage of a voltage generated in the capacitor of the control voltage supply means and a voltage generated in the electric current detecting element.

According to another aspect of a fluorescent lamp starter includes:

a series circuit to be connected to a power source for supplying an AC voltage, including a ballast and a fluorescent lamp equipped with electrodes;

a transistor having a collector and an emitter through a diode and an electric current detecting between the electrodes on a side of the fluorescent lamp in which the power source is not connected;

a control voltage supply means having a first resistance means and a capacitor connected between the collector and the emitter of the transistor; and a transistor base control means for switching the transistor by a total voltage of a voltage generated in the capacitor of the control voltage supply means and a voltage generated in the electric current detecting element;

wherein the transistor base control means comprises: a series circuit including a resistance means and a thyristor, connected between the collector and the emitter of the transistor; and a Zener diode connected between a junction, which is between the first resistance means and the capacitor, and a gate of the thyristor, and an anode and a cathode of the thyristor are connected to a base and an emitter of the transistor, respectively.

According to another aspect of a fluorescent lamp starter includes:

a fluorescent lamp having a pair of electrodes;

a ballast connected to one electrode of the pair of electrodes;

a first node connected to one electrode of the pair of electrodes;

a second node connected to the other electrode of the pair of electrodes;

a diode connected between one electrode of the pair of electrodes and the first node, or between the other electrode of the pair of electrodes and the second node;

a transistor including a collector connected to the first node, an emitter connected to the second node, and a base;

a control voltage supply means including a first resistance means and a capacitor connected in series between the first node and the second node; and a transistor base control means including a thyristor and a Zener diode, the thyristor having an anode connected to the first node via a second resistance means, and to the base of the transistor, a cathode connected to the second node, and a gate, the Zener diode connected between a junction of the first resistance mean and the capacitor, and the gate of the thyristor, the Zener diode allowing electrical conduction between the anode and the cathode of the thyristor so as to prevent a base current from being applied to the transistor, by applying a current to the gate of the thyristor when a voltage between the junction and the gate of the thyristor exceeds a prescribed value;

wherein, the control voltage supply means further includes a third resistance means connected between the junction of the first resistance means and the capacitor, and the capacitor.

According to another aspect of a fluorescent lamp starter includes:

a fluorescent lamp having a pair of electrodes;

a ballast connected to one electrode of the pair of electrodes;

a first node connected to one electrode of the pair of electrodes;

a second node connected to the other electrode of the pair of electrodes;

a diode connected between one electrode of the pair of electrodes and the first node, or between the other electrode of the pair of electrodes and the second node;

a transistor including a collector connected to the first node, and an emitter connected to the second node, and a base;

a control voltage supply means including a first resistance means and a capacitor connected in series between the first node and the second node; and a transistor base control means including a thyristor and a Zener diode, the thyristor having an anode connected to the first node via a second resistance means, and to the base of the transistor, a cathode connected to the second node, and a gate, the Zener diode connected between a junction of the first resistance mean and the capacitor, and the gate of the thyristor, the Zener diode allowing electrical conduction between the anode and the cathode of the thyristor so as to prevent a base current from being applied to the transistor, by applying a current to the gate of the thyristor when a voltage between the junction and the gate of the thyristor exceeds a prescribed value;

wherein, the fluorescent lamp starter further includes a third resistance means connected between the second node and the capacitor, and between the emitter of the transistor and the cathode of the thyristor.

Thus, the invention described herein makes possible the advantages of (1) providing a fluorescent lamp starter for reliably starting a fluorescent lamp with a single starting pulse, and (2) providing a fluorescent lamp starter having a simple configuration at a low production cost.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrating examples with reference to drawings.

EXAMPLE 1

Figure 1:
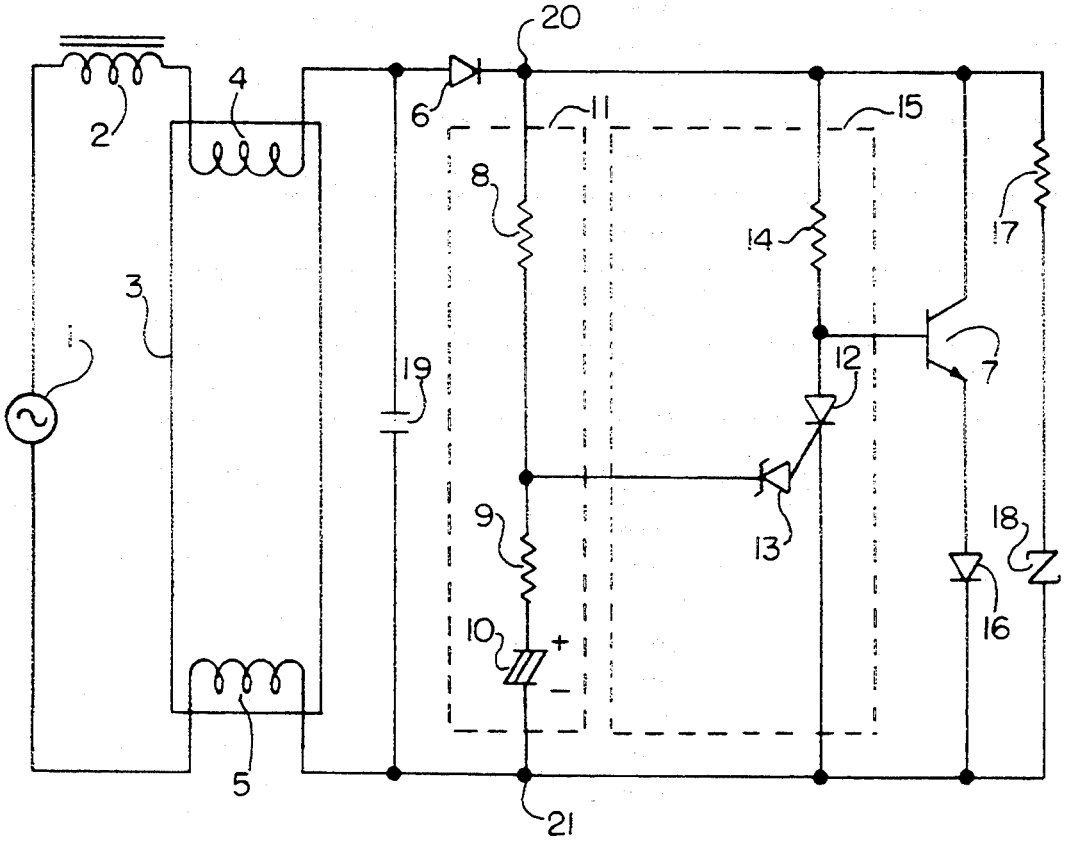
FIG. 1 is a circuit diagram for a fluorescent lamp starter according to a first example of the present invention.

FIG. 1 shows a fluorescent lamp starter according to a first example of the present invention. This fluorescent lamp starter includes a fluorescent lamp 3 having a pair of electrodes 4 and 5 which can be connected to an AC power source 1, a ballast 2 connected to one electrode of the pair of electrodes 4 and 5, a first node 20 connected to one electrode of the pair of electrodes via a diode 6, a second node 21 connected to the other electrode of the pair of electrodes, a transistor 7, a control voltage supply means 11, and a transistor base control means 15.

The transistor 7, the control voltage supply means 11, and the transistor base control means 15 are connected between the first node 20 and the second node 21.

The transistor 7 includes a collector connected to the first node 20, an emitter connected to the second node 21 via a diode 16, and a base. The control voltage supply means 11 includes resistance means 8, resistance means 9 and a capacitor 10, connected in series between the first node 20 and the second node 21. The transistor base control means 15 includes a thyristor 12 and a Zener diode 13. The thyristor 12 has an anode connected to the first node 20 via a resistance means 14 and to the base of the transistor 7, a cathode connected to the second node 21, and a gate. The Zener diode 13 is connected between a junction of the resistance means 8 and the resistance means 9, and the gate of the thyristor 12. The Zener diode 13 allows electrical conduction between the anode and the cathode of the thyristor 12 so as to prevent a base current from being applied to the transistor 7, by applying a current to the gate of the thyristor 12 when a voltage between the junction and the gate of the thyristor 12, i.e., the total voltage of the voltage across the resistance means 9 and the voltage across the capacitor 10, exceeds a prescribed value.

This fluorescent lamp starter further comprises a resistance means 17 and a surge-absorber 18 connected in series between the first node 20 and the second node 21, and another capacitor 19 for eliminating noises connected between the pair of electrodes 4 and 5.

Hereinafter, the operation of the starter according to the present example will be described.

Figure 2:
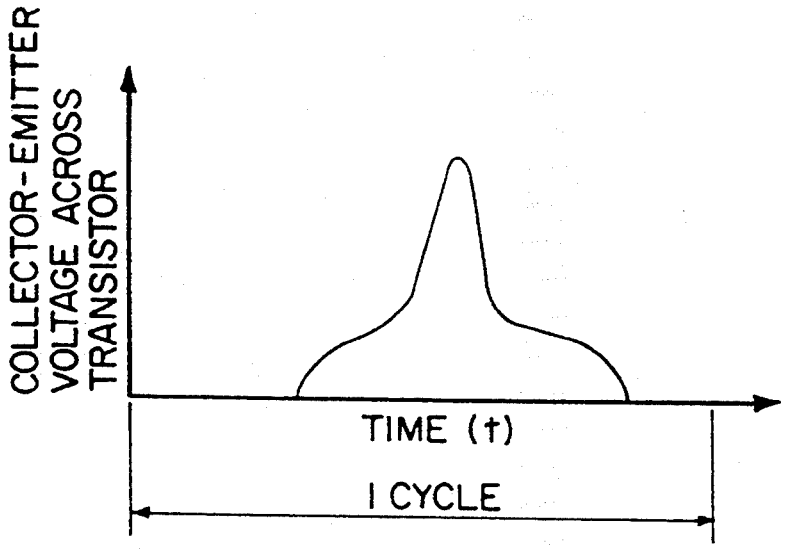
FIG. 2 shows a waveform of a collector-emitter voltage across a transistor according to the first and second examples.

If the AC power source 1 is turned ON to operate the starter, a base current is supplied to the base of the transistor 7 via the resistance means 14 from the AC power source 1 when the cycle of the power source voltage is positive, thereby allowing electrical conduction between the collector and the emitter of the transistor 7. As a result, the preheat current is applied from the AC power source 1 to the ballast 2, the electrode 4, the diode 6, the transistor 7, and the electrode 5. At this time, the voltage across either end of the control voltage supply means 11 which has the resistance means 8 and 9, and the capacitor 10 is the same voltage between the collector and the emitter of the transistor 7. The waveform of the voltage between the collector and the emitter (collector-emitter voltage) is shown in FIG. 2.

Every time the preheat current is applied so as to correspond to the half wave of the positive cycle of the power source voltage, the electrodes 4 and 5 of the fluorescent lamp 3 are preheated, and the capacitor 10 of the control voltage supply means 11 is charged via the resistance means 8 and 9.

Figure 3:
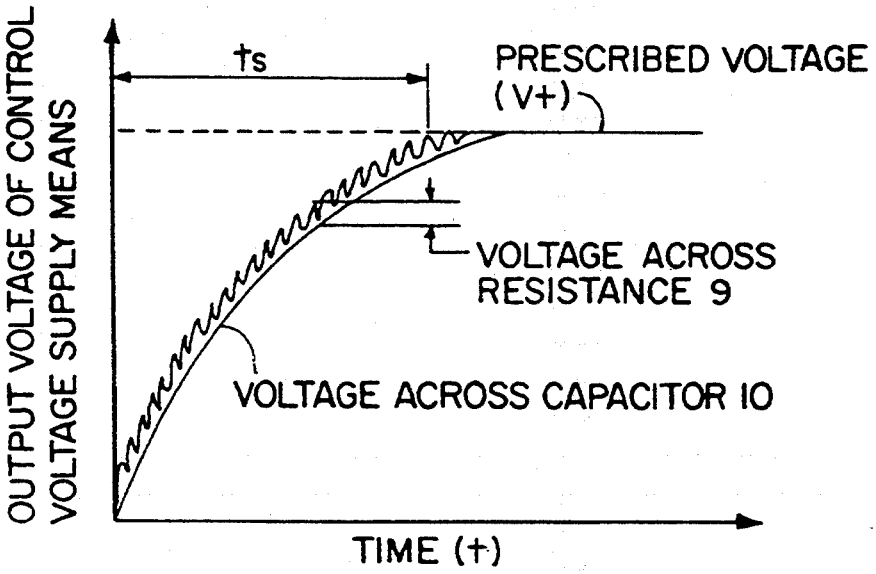
FIG. 3 shows a waveform of an output voltage of a control voltage supply means according to the first and second examples of the present invention.

As is seen from FIG. 3, an output voltage of the control voltage supply means 11, i.e., a voltage across the junction between the resistance means 8 and 9 is the total voltage of a voltage across the resistance means 9 and a voltage across the capacitor 10. The voltage across the resistance means 9 can be calculated from distributing the collector-emitter voltage across the transistor 7 between the resistance means 8 and 9 in proportion to respective resistance values thereof. Therefore, the waveform of the voltage across the resistance means 9 is symmetric with the waveform of the collector-emitter voltage across the transistor 7. The voltage across the capacitor 10 is increased with a time constant of $T=C_{10}\cdot(R_8+R_9)$ at every half-wave of the preheat cycle, wherein, $C_{10}$ denotes capacitance of the capacitor 10, and $R_8$ and $R_9$ denote resistance values of the resistance means 8 and 9, respectively. The output voltage of the control voltage supply means 11 is the total voltage of the voltage across the capacitor 10 and the voltage across the resistance means 9. The voltage across the resistance means 9 is changed at every cycle of the AC voltage. As a result, the capacitor voltage is gradually increased to approach a prescribed voltage, i.e., the total voltage of a Zener voltage of the Zener diode 13 and the turn-voltage between the gate and the cathode of the thyristor, and then the peak of a ripple voltage to which the voltage across the capacitor 10 is added exceeds the prescribed voltage at a time of ts. At this time, the current is applied to the gate of the thyristor 12 via the Zener diode 13, thereby turning ON the thyristor 12.

After the thyristor 12 is turned ON at the time of ts, the collector current of the transistor 7 is turned to an OFF-state when the collector-emitter voltage across the transistor 7 is around the peak. At this time, the current is prevented from being applied to the ballast 2, so that a pulse voltage $V_L$ is generated at the ballast 2 having inductance, thereby lighting the fluorescent lamp 3. Therefore, according to the present example, the pulse voltage $V_L$ is always generated when the voltage/current phase at either end of the fluorescent lamp 3 is about the peak, especially just before the peak. The reason is that the output voltage of the control voltage supply means 11, the collector-emitter voltage across the transistor 7, and the voltage across either end of the fluorescent lamp 3 are changed with much the same phase.

The pulse voltage $V_L$ is given by the following Equation (1):

$$V_L=I\cdot(L/(C_{19}+C_L))^{\frac{1}{2}} \quad (1)$$

wherein, I denotes an inductance current immediately before the transistor 7 is turned to the OFF-state, L denotes an inductance value of the ballast 2, $C_{19}$ denotes a capacitance of the capacitor 19 for eliminating noises, and $C_L$ denotes a floating capacitance.

At this time, energy $W_L$ for holding the inductance of the ballast 2 is given by the following Equation (2):

$$W_L = L \cdot I \cdot I/2 \quad (2)$$

The inductance current across the ballast 2, which is almost equal to the collector current across the transistor 7, is always prevented from being applied when the collector-emitter voltage across the transistor 7 is about the peak, especially just before the peak, so that the energy $W_L$ of the pulse generated at the ballast 2 inevitably shows a maximum value among values of pulse generation phases. Therefore, even if the pulse voltage is decreased by the capacitor 19 for eliminating noises or the like, the pulse voltage can remain sufficiently high, and a pulse having a sufficient width can be provided. Therefore, by such a pulse, the fluorescent lamp 3 can be supplied with enough energy to generate an arc discharge at the fluorescent lamp 3. As a result, by the pulse voltage generated at the starter of the present invention, the fluorescent lamp 3 can always be started reliably. Furthermore, according to the starter of the present invention, the fluorescent lamp 3 can always be broken down when the value of the current phase is around the peak, so that the arc discharge current immediately after the break down occurring can be increased, and a time period needed to cause the break down can be sufficiently prolonged. And when the break down occurs around the current peak, the voltage phase of the power source is in the leading edge having the same polarity of the current. Then it is possible to supply a lot of current to the fluorescent lamp after the break down. Therefore, the arc discharge condition immediately after the break down occurring can be kept stable. Accordingly, the fluorescent lamp 3 can be reliably started even at low atmospheric temperatures.

Moreover, according to the present invention, a pulse having a wider width can be generated, so that enough pulse voltage to light the fluorescent lamp can be provided even if the frequency-inductance characteristics of the ballast 2 are deteriorated at high frequencies of 30 to 40 kHz due to the deviation from the design values and the environmental change. Therefore, the present invention can expand the general application of the fluorescent lamp starter.

When the fluorescent lamp 3 is burning, the voltage between the electrodes on the opposite side of the power source is decreased to the burning lamp voltage level. Moreover, while the fluorescent lamp 3 is burning, due to the presence of the resistance means 9 and the wave form of the burning lamp voltage is square, the voltage across the capacitor 10 is little decreased during the half cycle of AC, and the thyristor 12 remains ON. Therefore, the transistor 7 always remains ON, so that no pulse is generated at the ballast 2. As a result, the fluorescent lamp 3 remains burning.

As is described above, according to the fluorescent lamp starter of the present invention, it is possible to set a generation phase of the pulse voltage at around the peak value of the half cycle of the preheat current by way of using a simplified and economical circuit, thereby starting the fluorescent lamp smoothly and stably. Moreover, the starter using such a circuit can be produced with simplified processes at a low cost. In addition to the simplification and low production cost, the starter of the present invention has an advantage in that the fluorescent lamp can reliably be started, irrespective of environmental change, even if a generally used ballast is employed for the circuit thereof.

According to the present example; in a case where a power source to supply a power source voltage of 100 to 240 V is used as the AC power source 1, and a standard fluorescent lamp having a consumption electric power of 6 to 60 W is used as the fluorescent lamp 3, the resistance means 8 preferably has a resistance value of 10 kΩ to 1 MΩ or a consumption electric power of 0.1 to 0.5 W, the resistance means 9 preferably has a resistance value of 100 Ω to 5 kΩ or a consumption electric power of 0.1 to 0.5 W, and the capacitor 10 preferably has an electric capacitance of 1 to 100 μF. On the other hand, in a case where a power source to supply a power source voltage of 100 V is used as the AC power source 1, and a standard fluorescent lamp having a consumption electric power of 20 or 30 W is used as the fluorescent lamp 3, the resistance means 8 preferably has a resistance value of 10 to 100 kΩ or a consumption electric power of 0.1 to 0.25 W, the resistance means 9 preferably has a resistance value of 100 Ω to 2 kΩ or a consumption electric power of 0.1 to 0.25 W, and the capacitor 10 preferably has an electric capacitance of 4.7 to 47 μF. The reason will be described below.

In order to satisfy a demand for making the fluorescent lamp starter as small as possible, respective resistance means preferably have a small resistance value of 0.1 to 0.5 W. Furthermore, it generally takes 0.5 to 2 seconds for the preheat time to start the fluorescent lamp 3, so that the time constant of the control voltage supply means 11 should be set in accordance with the preheat time. In addition, a trigger signal current for the transistor base control means 15, which is applied to the Zener diode 13, should be set on a level sufficiently larger than the noise level, i.e., at 1 to 100 μA. Furthermore, the resistance means 9 is applied with a current via the resistance means 8 so that the capacitor 10 can be charged with a voltage of 10 to 150 V which is applied to the transistor 7 so as to be turned ON. At this time, the voltage generated at the resistance means 9 should be on a noise level (a few mV) or more. In order to make the phase of the charge voltage of the capacitor 10 clear, the total current of the gate leakage current of the thyristor 12 and the leakage current of the capacitor 10 should be applied from the resistance means 8 to the capacitor 10. Furthermore, even if the fluorescent lamp 3 loses the burning ability at the last stage of the life, and then the respective elements of the starter are directly applied with the power source voltage, it is required that nothing unusual will happen with the respective elements.

By using the elements having the abovementioned properties according to the present example, it is possible to provide a smaller size of fluorescent lamp starter which will scarcely malfunction.

For example, when used with a circuit provided with the resistance means 8 having a resistance value of 36 kΩ, the resistance means 9 having a resistance value of 100 Ω, the capacitor 10 having capacitance of 47 μF, and the Zener diode 13 having a Zener voltage of 5.1 V, the starting of the fluorescent lamp 3 is ensured with a first pulse voltage after the AC power source is turned ON.

According to the present example, the transistor base control means 15 makes the thyristor 12 turned ON when the output voltage of the control voltage supply means reaches a prescribed value, thereby turning OFF the transistor 7 which has been in the ON-state. However, the configuration for the transistor base control means 15 is not limited to the above, but many other configurations may also be employed. Furthermore, the diode 16 is not indispensable, but may be omitted.

EXAMPLE 2

Next, a fluorescent lamp starter according to a second example of the present invention will be described with reference to FIG. 4.

Figure 4:
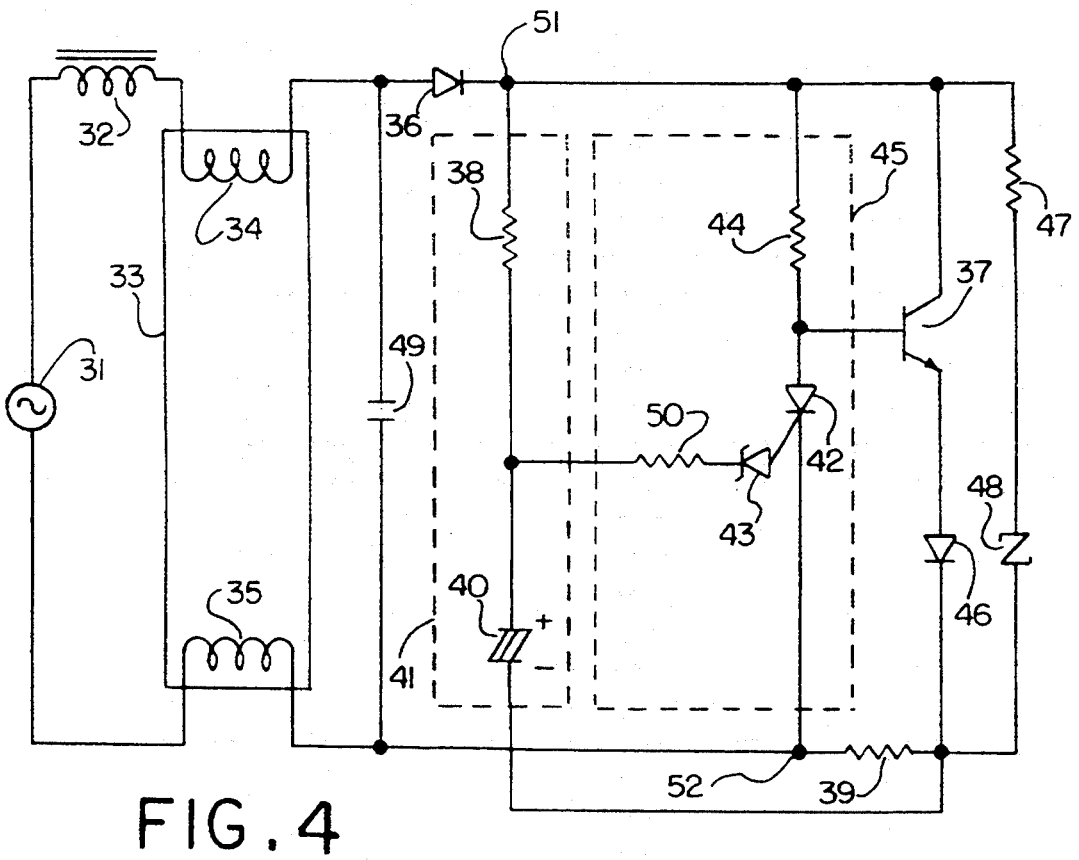
FIG. 4 is a circuit diagram for a fluorescent lamp starter according to the second example of the present invention.
Figure 5:
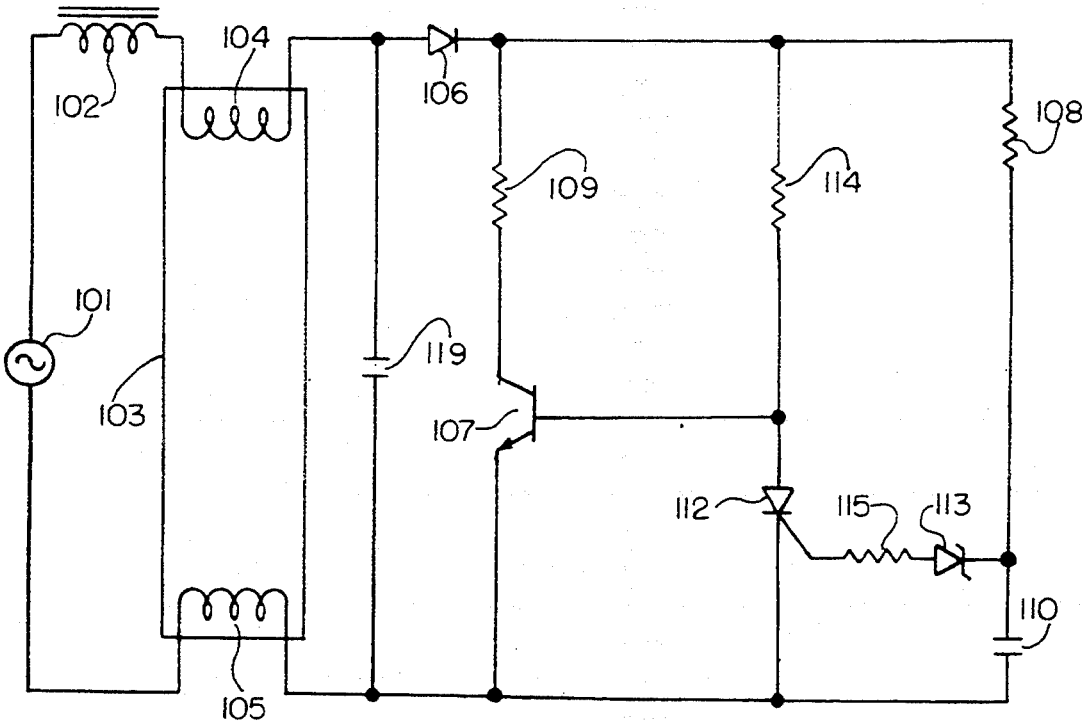
FIG. 5 PRIOR ART
FIG. 5 is a circuit diagram for a conventional fluorescent lamp starter.

FIG. 4 shows a fluorescent lamp starter according to a second example of the present invention. This fluorescent lamp starter includes a fluorescent lamp 33 having a pair of electrodes 34 and 35 which can be connected to an AC power source 31, a ballast 32 connected to one electrode of the pair of electrodes, a first node 51 connected to one electrode of the pair of electrodes via a diode 36, a second node 52 connected to the other electrode of the pair of electrodes, a transistor 37, a control voltage supply means 41, and a transistor base control means 45. The transistor 37, the control voltage supply means 41, and the transistor base control means 45 are connected between the first node 51 and the second node 52.

The transistor 37 includes a collector connected to the first node 51, an emitter connected to the second node 52 via a diode 46 and a resistance means 39 which works as an electric current detecting element, and a base. The control voltage supply means 41 includes resistance means 38, and a capacitor 40, connected in series between the first node 51 and the second node 52 via the resistance means 39. The transistor base control means 45 includes a thyristor 42, resistance means 50 and a Zener diode 43. The thyristor 42 has an anode connected to the first node 51 via a resistance means 44 and to the base of the transistor 37, a cathode connected to the second node 52, and a gate. The resistance means 50 and the Zener diode 43 are connected between a junction of the resistance means 38 and the capacitor 40, and the gate of the thyristor 42. The Zener diode 43 allows electrical conduction between the anode and the cathode of the thyristor 42 so as to prevent a base current from being applied to the transistor 37, by applying a current to the gate of the thyristor 42 when a voltage across the Zener diode 43 exceeds a prescribed value.

This fluorescent lamp starter further comprises a resistance means 47 and a surge-absorber 48 connected in series between the first node 51 and the second node 52, and another capacitor 49 for eliminating noises connected between the pair of electrodes 34 and 35.

Hereinafter, the operation of the starter according to the second example will be described.

If the AC power source 31 is turned ON to operate the starter, a base current is supplied to the base of the transistor 37 via the diode 36 and the resistance means 44 from the AC power source 31 when the cycle of the power source voltage is positive, thereby allowing electrical conduction between the collector and the emitter of the transistor 37. As a result, the preheat current is applied from the AC power source 31 to the ballast 32, the electrode 34, the diode 36, the transistor 37, the diode 46, the resistance means 39, and the electrode 35. At this time, the voltage across either end of the control voltage supply means 41 which has the resistance means 38 and the capacitor 40 is the same voltage between the collector and the emitter of the transistor 37. The waveform of the voltage between the collector and the emitter (collector-emitter voltage) is shown in FIG. 2.

Every time the preheat current is applied so as to correspond to a half wave of the positive cycle of the power source voltage, the electrodes 34 and 35 of the fluorescent lamp 33 are preheated, and the capacitor 40 of the control voltage supply means 41 is charged via the resistance means 38 and 39.

As is seen from FIG. 3, an output voltage of the control voltage supply means 41, i.e., a voltage across the junction between the resistance means 38 and the capacitor 40, is the total voltage of a voltage across the capacitor 40 and a voltage across the resistance means 39. At this time, the waveform of the voltage across the resistance means 39 is symmetric with the waveform of the collector current of the transistor 37.

The voltage across the capacitor 40 is increased with a time constant of $T=C_{40}\cdot R_{38}$ at every half-wave of the preheat cycle, wherein, $C_{40}$ denotes capacitance of the capacitor 40, and $R_{38}$ denotes the resistance value of the resistance means 38. The output voltage of the control voltage supply means 41 is the total voltage of the voltage across the capacitor 40 and the voltage across the resistance means 39. The voltage across the resistance means 39 is changed at every cycle of the AC voltage. As a result, the capacitor voltage is gradually increased to approach a prescribed voltage, and then the peak of a ripple voltage to which the voltage across the capacitor 40 is added exceeds the prescribed voltage at a time of ts. At this time, the current is applied to the gate of the thyristor 42 via the Zener diode 43, thereby turning ON the thyristor 42.

After the thyristor 42 is turned ON at the time of ts, the collector current of the transistor 37 is turned to an OFF-state when the collector-emitter voltage across the transistor 37 is around the peak. At this time, the current is prevented from being applied to the ballast 32, so that a pulse voltage $V_L$ is generated at the ballast 32 having inductance, thereby starting the fluorescent lamp 33. Therefore, according to the present example, the pulse voltage $V_L$ is always generated when the voltage/current phase at either end of the fluorescent lamp 33 is about the peak, especially just before the peak. The reason is that the output voltage of the control voltage supply means 41, the voltage of the resistance 39, and the voltage across either end of the fluorescent lamp 33 are changed with much the same phase.

The pulse voltage $V_L$ is given by the following Equation (3):

$$V_L=I\cdot(L/(C_{49}+C_L))^{\frac{1}{2}} \quad (3)$$

wherein, I denotes an inductance current immediately before the transistor 37 is turned to the OFF-state, L denotes an inductance value of the ballast 32, $C_{49}$ denotes a capacitance of the capacitor 49 for eliminating noises, and $C_L$ denotes a floating capacitance.

At this time, energy $W_L$ for holding the inductance of the ballast 32 is given by the following Equation (4):

$$W_L=L\cdot I\cdot I/2 \quad (4)$$

The inductance current across the ballast 32, which is almost equal to the collector current of the transistor 37, is always prevented from being applied when the collector-emitter voltage across the transistor 37 is around the peak i.e. collector current of the transistor 37 is about the peak, especially just before the peak, so that the energy $W_L$ of the pulse generated at the ballast 32 inevitably shows a maximum value among values of pulse generation phases. Therefore, even if the pulse voltage is decreased by the capacitor 49 for eliminating noises or the like, the pulse voltage can remain sufficiently high, and a pulse having a sufficient width can be provided. Therefore, by the pulse, the fluorescent lamp 33 can be supplied with enough energy to generate arc discharge at the fluorescent lamp 33. As a result, by the pulse voltage generated at the starter of the present invention, the fluorescent lamp 33 can always be started reliably. Furthermore, according to the starter of the present invention, the fluorescent lamp 33 can always be broken down when the value of the current phase is around the peak, especially just before the peak, so that the arc discharge current immediately after the break down occurs can be increased, and the time needed to cause the break down can be sufficiently prolonged. And when the break down occurs around the current peak, the voltage phase of the power source is in the leading edge having the same polarity of the current. Then it is possible to supply a lot of current to the fluorescent lamp after the break down. Therefore, the arc discharge condition immediately after the break down occurs can be kept stable. As a result, the fluorescent lamp 33 can reliably be started even at low atmospheric temperatures.

Moreover, according to the present invention, a pulse having a wider width can be generated, so that enough pulse voltage to start the fluorescent lamp 33 can be provided even if the frequency-inductance characteristics of the ballast 32 are deteriorated at high frequencies of 30 to 40 kHz due to the deviation from the design values and the environmental change. Therefore, the present invention can expand the general applications of the fluorescent lamp starter.

When the fluorescent lamp 33 is burned, the voltage between the electrodes 34 and 35 of the fluorescent lamp 33 on the opposite side of the power source 31 is decreased to the burning lamp voltage level. Moreover, while the fluorescent lamp 33 is burned, due to the presence of the resistance means 39 and the waveform of the burning lamp voltage that is square, the voltage across the capacitor 40 is little decreased during the half-cycle of the AC, and the thyristor 42 always remains ON. Therefore, the transistor 37 always remains ON, so that no pulse is generated at the ballast 32. As a result, the fluorescent lamp 33 remains burning stably.

As is described above, according to the fluorescent lamp starter of the present invention, it is possible to set a generation phase of the pulse voltage at around the peak value of the half cycle of the preheat current by way of using a simplified and economical circuit. Therefore, the starter makes it possible to reliably and smoothly start the fluorescent lamp 33.

According to the present example, in a case where a power source to supply a power source voltage of 100 to 240 V is used as the AC power source 31, and a standard fluorescent lamp having a consumption electric power of 6 to 60 W is used as the fluorescent lamp 33, the resistance means 39 preferably has a resistance value of 10 mΩ to 10 Ω or a consumption electric power of 0.25 W or less. The reason will be described below.

The resistance means 39 is required to generate a voltage of a few mV or more with a current of 0.3 to 5 A which is applied to the resistance means 39 during the preheat time to start the fluorescent lamp 33, since the voltage of a few mV or more is needed as a trigger voltage for the thyristor 42. The resistance means 39 is further required to have a consumption electric power of 0.25 W or less so that nothing unusual will happen with the resistance means 39 and the size of the resulting starter will be made small.

By using the elements having the above-mentioned properties according to the present example, it is possible to provide a smaller size of fluorescent lamp starter which will scarcely malfunction.

Moreover, sufficient effects can be obtained even if the resistance means 39 has a resistance value of approximately 10 mΩ. Therefore, a pattern of a print substrate and a jumper line may be employed for the resistance means 39. At this time, the starter of the present example can be further simplified.

According to the starter of the present example, by using the resistance means 39 as the electric current detecting element, a preheat current waveform can correctly be transformed into a voltage waveform so as to more correctly detect the peak, especially just before the peak, of the preheat current, thereby further ensuring the lighting of the fluorescent lamp 33.

Thus, a starter using such a circuit can be produced with simplified processes at a low cost. In addition to the simplification and low production cost, the starter of the present example has an advantage in that the fluorescent lamp can reliably be started with a first pulse voltage, irrespective of environmental change, even if a generally used ballast is employed for the circuit thereof.

According to the present example, the transistor base control means 45 makes the thyristor 42 turned ON when the output voltage of the control voltage supply means 41 reaches the prescribed value, thereby turning OFF the transistor 37 which has been in an ON-state. However, the configuration for the transistor base control means 45 is not limited to the above, but many other configurations may also be employed. Furthermore, the diode 46 is not indispensable, but may be omitted.

Some exemplary values for resistance means, capacitors, and voltages are mentioned above. It will be appreciated that other values which will enable operation of the invention described also may be used.

A various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A fluorescent lamp starter comprising:

a series circuit to be connected to a power source for supplying an AC voltage, including a ballast and a fluorescent lamp equipped with electrodes;

a transistor having a collector and an emitter connected through a diode between said electrodes on an opposite side of said fluorescent lamp in which said power source is not connected;

a control voltage supply means having a resistance means and a capacitor, which are operated by a voltage between said collector and said emitter of said transistor; and a transistor base control means for switching said transistor by a total voltage of a part of a voltage generated in said resistance means of said control voltage supply means and a voltage generated in said capacitor thereof.

2. A fluorescent lamp starter comprising:

a series circuit to be connected to a power source for supplying an AC voltage, including a ballast and a fluorescent lamp equipped with electrodes;

a transistor having a collector and an emitter connected through a diode between said electrodes on an opposite side of said fluorescent lamp in which said power source is not connected;

a control voltage supply means having a series circuit including a first resistance means, a second resistance means, and a capacitor connected between said collector and said emitter of said transistor; and a transistor base control means for switching said transistor by a total voltage of a voltage generated in said second resistance means of said control voltage supply means and a voltage generated in said capacitor thereof, wherein said transistor base control means comprises: a series circuit including a resistance means and a thyristor, connected between said collector and said emitter of said transistor; and a Zener diode connected between a junction, which is between said first resistance means and a series circuit including said second resistance means and said capacitor, and a gate of said thyristor, and an anode and a cathode of said thyristor are connected to a base and an emitter of said transistor, respectively.

3. A fluorescent lamp starter comprising:

a series circuit to be connected to a power source for supplying an AC voltage, including a ballast and a fluorescent lamp equipped with electrodes;

a transistor having a collector and an emitter connected through a diode and an electric current detecting element between said electrodes on an opposite side of said fluorescent lamp in which said power source is not connected;

a control voltage supply means having a resistance means and a capacitor, which are operated by a voltage between said collector and said emitter of said transistor; and a transistor base control means for switching said transistor by a total voltage of a voltage generated in said capacitor of said control voltage supply means and a voltage generated in said electric current detecting element.

4. A fluorescent lamp starter comprising:

a series circuit to be connected to a power source for supplying an AC voltage, including a ballast and a fluorescent lamp equipped with electrodes;

a transistor having a collector and an emitter through a diode and an electric current detecting element between said electrodes on a side of said fluorescent lamp in which said power source is not connected;

a control voltage supply means having a first resistance means and a capacitor connected between said collector and said emitter of said transistor; and a transistor base control means for switching said transistor by a total voltage of a voltage generated in said capacitor of said control voltage supply means and a voltage generated in said electric current detecting element;

wherein said transistor base control means comprises: a series circuit including a resistance means and a thyristor, connected between said collector and said emitter of said transistor; and a Zener diode connected between a junction, which is between said first resistance means and said capacitor, and a gate of said thyristor, and an anode and a cathode of said thyristor are connected to a base and an emitter of said transistor, respectively.

5. A fluorescent lamp starter comprising:

a fluorescent lamp having a pair of electrodes;

a ballast connected to one electrode of said pair of electrodes;

a first node connected to one electrode of said pair of electrodes;

a second node connected to the other electrode of said pair of electrodes;

a diode connected between one electrode of said pair of electrodes and said first node, or between the other electrode of said pair of electrodes and said second node;

a transistor including a collector connected to said first node, an emitter connected to said second node, and a base;

a control voltage supply means including a first resistance means and a capacitor connected in series between said first node and said second node; and a transistor base control means including a thyristor and a Zener diode, said thyristor having an anode connected to said first node via a second resistance means, and to the base of said transistor, a cathode connected to said second node, and a gate, said Zener diode connected between a junction of said first resistance mean and said capacitor, and the gate of said thyristor, said Zener diode allowing electrical conduction between the anode and the cathode of said thyristor so as to prevent a base current from being applied to said transistor, by applying a current to the gate of said thyristor when a voltage between said junction and the gate of said thyristor exceeds a prescribed value;

wherein, said control voltage supply means further includes a third resistance means connected between said junction of said first resistance means and said capacitor, and said capacitor.

6. A fluorescent lamp starter according to claim 5, further comprising a fourth resistance means and a surge-absorber connected in series between said first node and said second node.

7. A fluorescent lamp starter comprising:

a fluorescent lamp having a pair of electrodes;

a ballast connected to one electrode of said pair of electrodes;

a first node connected to one electrode of said pair of electrodes;

a second node connected to the other electrode of said pair of electrodes;

a diode connected between one electrode of said pair of electrodes and said first node, or between the other electrode of said pair of electrodes and said second node;

a transistor including a collector connected to said first node, and an emitter connected to said second node, and a base;

a control voltage supply means including a first resistance means and a capacitor connected in series between said first node and said second node; and a transistor base control means including a thyristor and a Zener diode, said thyristor having an anode connected to said first node via a second resistance means, and to the base of said transistor, a cathode connected to said second node, and a gate, said Zener diode connected between a junction of said first resistance mean and said capacitor, and the gate of said thyristor, said Zener diode allowing electrical conduction between the anode and the cathode of said thyristor so as to prevent a base current from being applied to said transistor, by applying a current to the gate of said thyristor when a voltage between said junction and the gate of said thyristor exceeds a prescribed value;

wherein, said fluorescent lamp starter further includes a third resistance means connected between said second node and said capacitor, and between said emitter of said transistor and said cathode of said thyristor.

8. A fluorescent lamp starter according to claim 7, further comprising a fourth resistance means and a surge-absorber connected in series between said first node and said second node.

* * * * *